US012331497B2

(12) United States Patent
Schürle et al.

(10) Patent No.: US 12,331,497 B2
(45) Date of Patent: Jun. 17, 2025

(54) SANITARY KIT, SANITARY FUNCTIONAL ARRANGEMENT AND METHOD FOR PRODUCING A SANITARY FUNCTIONAL ARRANGEMENT

(71) Applicant: Neoperl GmbH, Müllheim (DE)

(72) Inventors: Holger Schürle, Müllheim (DE); Fabian Wildfang, Müllheim (DE); Christoph Weis, Müllheim (DE)

(73) Assignee: NEOPERL GMBH, Mullheim (DE)

( * ) Notice: Subject to any disclaimer, the term of this patent is extended or adjusted under 35 U.S.C. 154(b) by 276 days.

(21) Appl. No.: 17/914,802

(22) PCT Filed: Mar. 19, 2021

(86) PCT No.: PCT/EP2021/057150
§ 371 (c)(1),
(2) Date: Sep. 27, 2022

(87) PCT Pub. No.: WO2021/209224
PCT Pub. Date: Oct. 21, 2021

(65) Prior Publication Data

US 2023/0146601 A1 May 11, 2023

(30) Foreign Application Priority Data

Apr. 14, 2020 (DE) ..... 202020102039.0

(51) Int. Cl.
*E03C 1/04* (2006.01)
*E03C 1/02* (2006.01)

(52) U.S. Cl.
CPC ..... *E03C 1/0403* (2013.01); *E03C 1/021* (2013.01); *E03C 1/023* (2013.01); *E03C 1/04* (2013.01); *E03C 1/0405* (2013.01); *E03C 2201/30* (2013.01); *E03C 2201/40* (2013.01)

(58) Field of Classification Search
CPC ..... E03C 1/0403; E03C 1/0405; E03C 2201/40; E03C 2201/30; E03C 1/04; E03C 1/021; E03C 1/023
See application file for complete search history.

(56) References Cited

U.S. PATENT DOCUMENTS 4,654,900 A 4/1987 McGhee
4,731,545 A * 3/1988 Lerner ..... F03B 13/04 416/185
5,133,094 A * 7/1992 Clarke, Jr. ..... E03C 1/021 248/68.1
5,375,887 A 12/1994 Johnson
(Continued)

FOREIGN PATENT DOCUMENTS

CN 201915451 8/2011
CN 103697212 8/2014
(Continued)

*Primary Examiner* — Frederick C Nicolas
(74) *Attorney, Agent, or Firm* — Volpe Koenig

(57) ABSTRACT

A sanitary construction kit (1) having at least one outflow element (2), at least one control element (3), and at least one connection element (4) by way of which the outflow element (2) is fluidically connectable to the control element (3). At least two functionally dissimilar control elements (3) which selectively, individually or together, are fluidically connectable to the outflow element (2) are provided.

28 Claims, 6 Drawing Sheets

(56) References Cited

U.S. PATENT DOCUMENTS

| | | | | |
|---|---|---|---|---|
| 2009/0026768 | A1* | 1/2009 | Shimizu ..... | F03B 13/00 415/185 |
| 2009/0026769 | A1 | 1/2009 | Shimizu et al. | |
| 2015/0159765 | A1 | 6/2015 | Wawrla et al. | |
| 2016/0348345 | A1 | 12/2016 | Rowland et al. | |

FOREIGN PATENT DOCUMENTS

| | | | |
|---|---|---|---|
| CN | 104019254 | A | 9/2014 |
| CN | 213296524 | | 5/2021 |
| DE | 10339096 | | 3/2005 |
| DE | 10343249 | | 4/2005 |
| DE | 102004005161 | | 8/2005 |
| DE | 102007012946 | | 9/2008 |
| EP | 0715112 | | 6/1996 |
| EP | 3098355 | | 11/2016 |
| EP | 0667472 | | 10/2021 |
| JP | 2009108990 | A | 5/2009 |

* cited by examiner

SANITARY KIT, SANITARY FUNCTIONAL ARRANGEMENT AND METHOD FOR PRODUCING A SANITARY FUNCTIONAL ARRANGEMENT

TECHNICAL FIELD

The invention relates to a sanitary construction kit having at least one outflow element, at least one control element, and at least one connection element by way of which the outflow element is fluidically connectable to the control element.

The invention furthermore relates to a sanitary functional assembly having at least one outflow element, at least one control element, at least one connection element by way of which the outflow element is fluidically connected to the control element.

Moreover, the invention relates to a method for producing a sanitary functional assembly.

BACKGROUND

Sanitary functional assemblies are required at the most varied locations and for the most varied sanitary installations. However, if the installation situation deviates from a customary standard such that individual solutions have to be achieved, it is however often very difficult for such individual solutions to be implemented by means of known commercially available products.

For example, when installing sanitary functional assemblies which are to be integrated in items of furniture or sanitary objects, it arises again and again that previously known solutions are unsuitable because the latter cannot be flexibly adapted to a specific space or to a limitation predefined by the installation situation. In particular when bespoke items of furniture are to be equipped with a sanitary functional assembly there is a lack of suitable solutions in order to be able to equip the items of furniture with a sanitary functional assembly in an individualized and simple manner.

SUMMARY

The object on which the invention is based thus lies in achieving a technical solution in order to be able to configure sanitary functional assemblies in a simpler and more flexible manner.

According to the invention, the achievement of this object is in each case provided by one or more of the features disclosed herein.

Proposed in particular in order to achieve the object according to the invention is a sanitary construction kit having at least one outflow element, at least one control element, and at least one connection element by way of which the outflow element is fluidically connectable to the control element, wherein at least two control elements which selectively are fluidically connectable to the outflow element are present. The control elements can be configured so as to be functionally dissimilar or identical, for example.

In particular, further proposed alternatively or additionally to the previous paragraph in order to achieve the object according to the invention is a sanitary construction kit having at least one outflow element, at least one control element, at least one connection element by way of which the outflow element is fluidically connectable to the control element, wherein at least one distributor to which at least two, preferably functionally dissimilar, control elements, connection elements and/or outflow elements are simultaneously connectable is present. The distributor here can be configured separately and/or without actuation, for example, or so as to be integrated in the control element (for example for forming a switchover unit).

As a result of the construction kit according to the invention as described and/or claimed herein being provided, it is possible for tradesmen, designers, manufacturers and also a layperson to configure a sanitary functional assembly for sanitary objects in a simple and flexible manner. Design embodiments which suit requirements in terms of an available space and/or a desired functionality can be designed by means of the sanitary construction kit.

Advantageous design embodiments of the invention which can be combined individually or in combination with the features of other design embodiments, optionally conjointly with other ones of the described herein.

For example, the at least one outflow element can be configured for shaping dissimilarly shaped jet shapes. In particular for configuring at least one or a plurality of jet shapes selected from: aerated, non-aerated, pulsed, spray, continuous, CO2-enriched (may also be achieved by way of a functional unit), filtered (may also be achieved by way of a functional unit), unfiltered, distilled (may also be achieved by way of a functional unit). Alternatively or additionally thereto, the jet can be heated or unheated, in particular when a functional unit configured as a flow heater is provided. Furthermore alternatively or additionally, the jet can be cooled, in particular when a functional unit configured as a flow chiller is provided.

According to one advantageous refinement it can be provided that the at least one connection element is configured so as to be plug-connectable and/or that the at least one connection element is configured so as to be variable in terms of shape. In this way it is possible for the connection element to be able to be assembled in a simple manner. In particular, the connection element can be assembled without tools.

According to one further advantageous design embodiment, at least one connector element can be configured for connecting to a supply network. In this way, the sanitary functional assembly produced from the construction kit can be used in a particularly simple manner for controlling a water supply.

According to one particularly advantageous refinement it can be provided that a functional unit, in particular a further control element, a sensor and/or an actuator, for example a flow heater and/or a current generator, are/is connectable, in particular plug-connectable to the control element and/or to the outflow element and/or to the or a further preferably plug-compatible connection element. In this way, special functionalization can be performed in a simple manner in that a specific functional unit is used.

In order to be able to achieve a respective suitable solution for a plurality of dissimilar installation situations, it can be provided that at least two dissimilar, in particular dissimilarly shaped and/or dissimilarly long, connection elements having conforming connectors are present. In this way it is possible for establishing a connection by way of the respective connection element that matches the installation situation.

According to an advantageous design embodiment it can furthermore be provided that fastening means are configured for fastening the at least one outflow element and/or the at least one control element and/or the at least one connection element to the functional carrier. The functional carrier and/or the fastening means here can at least partially be part of an item of furniture, for example, or be separately configured.

For example, the functional carrier can generally be a 3D member of arbitrary shape, in particular also a design object such as a waterspout, preferably a supporting board or a lateral wall or a rear wall or a screen or a cover or part of the aforementioned. A receptacle channel, for example the receptacle channel mentioned further below, is preferably configured such that said receptacle channel is not visible when the item of furniture is in use.

According to a further advantageous design embodiment, at least one bifurcation element can be provided. A bifurcation element which bifurcates by more than two-fold, in particular three-fold or multiple times, can be provided in particular, said bifurcation element for forming the or a distributor being selectively connectable to at least one or to the at least one connection element, for example a further connection element.

In order for simple operability to be established, it can be provided that the at least one control element has a manual operating element. In particular, the manual operating elements of two dissimilar control elements can have a conforming external contour and/or a conforming external dimension. In this way, the installation location can be of a uniform design, for example in that suitable templates and/or construction plans are used for preparing the installation location.

According to one advantageous refinement it can be provided that at least two dissimilar outflow elements, for example of dissimilar flowrate classes and/or jet shapes and/or jet types, are selectively connectable to at least one control element, in particular connectable by way of a uniform connection element. The construction kit can comprise in particular outflow elements which are specified for generating at least one individual jet and/order at least one spray jet. Alternatively or additionally, it can furthermore be provided that at least one filter is configured or disposed on the outflow element and/or upstream of the outflow element in the flow direction, so as to provide filtered water.

According to one further advantageous refinement it can be provided that a current generator, in particular having an electric interim storage, is present, said current generator being operatively connectable to a water circuit comprising the outflow element, in particular fluidically connectable to the control element, the connection element and/or the outflow element. In this way, it is possible that current for a consumer, for example for supplying at least one control element, is able to be generated by means of the current generator.

For example, it can be provided that the at least one control element is a manually controllable valve. This enables sanitary functional assemblies which are able to be manually operated. Alternatively or additionally, it can be provided that the control element is configured as a temperature-controlled and/or pressure-controlled valve. Automatic actuations can thus be established. The control element can in particular be a shut-off valve, a valve having an opening cross section that can be adjusted in a stepless manner or in fine steps, a two-way valve, a switchover unit, or a mixer unit, so as to represent or implement dissimilar functionalities.

According to one advantageous refinement, it can be provided that a connection element, for example the connection element already mentioned, is composed of a temperature-resistant material, in particular wherein the connection element is conceived for temperatures above 100° C. In this way it is possible to also route very hot liquids such as boiling water.

According to one advantageous refinement it can be provided that a connection element, for example the connection element already mentioned, is configured as a flexible hose. In this way, the lines of the connection elements can be routed in a flexible manner almost without any restrictions.

Furthermore proposed according to the invention for achieving the object mentioned at the outset is in particular a sanitary functional assembly having at least one outflow element, at least one control element and at least one connection element by way of which the outflow element is fluidically connected to the control element, wherein at least two dissimilar control elements are present, wherein the control elements are fluidically disposed in parallel or in series, and/or each control element is assigned an individual and/or a common outflow element. The sanitary functional assembly is preferably produced from a sanitary construction kit as is described and/or claimed herein.

For example, it can be provided here that the at least two control elements are connected by way of, in particular flexible, connection elements. In this way, the control elements are able to be assembled so as to be spaced apart and/or operated when spaced apart.

Provided alternatively or additionally according to the invention for achieving the object are the features of the coordinate claim which is directed toward a sanitary functional assembly. Proposed, in particular, according to the invention for achieving the object mentioned in a sanitary functional assembly of the type described at the outset is thus that at least two outflow elements are present, wherein the outflow elements are fluidically disposed in parallel or in series, and/or each outflow element is assigned an individual and/order common control element. In this way, a plurality of outflow elements are able to be operated simultaneously.

The outflow elements are preferably configured so as to be mutually dissimilar. In this way, dissimilar jet shapes or jet qualities are able to be controlled conjointly or in a mutually independent manner. Sanitary function assemblies which have identical outflow elements are also able to be implemented, for example in irrigation systems or massage nozzles.

According to one advantageous refinement, the two control elements can be fed from a common distributor element. In this way it is possible to achieve two dissimilar control possibilities and/or functionalities without two supply connectors being required.

According to one advantageous refinement, it can be provided that the at least two control elements are in each case fed from a separate supply connector. In this way it is possible for a plurality of outflow elements by way of one or a plurality of control elements to be connected in each case to one supply connector. The number of outflow elements here may be less than, equal to or more than the number of supply connectors. In this way, a plurality of supply connectors, for instance by way of combination units of mixer units, can also be allocated to one outflow element, or one supply connector can be allocated to a plurality of outflow elements. It can be provided here that one individual control element is in each case present for each of the plurality of separate supply connectors. It is particularly favourable for each of the control elements to be configured as a push-push mechanism.

Proposed according to the invention for achieving the object mentioned at the outset is in particular a method for producing a sanitary functional assembly, wherein a functional carrier is equipped with the functional assembly, wherein at least one dimension of the functional carrier is entered, that a desired scope of functions is entered, that at least one outflow element, at least one control element and at least one connection element are selected from a sanitary construction kit such as described and/or claimed herein, and a circuit diagram is generated such that the desired scope of functions is implemented, that a layout for placing the selected elements of the sanitary construction kit within the at least one dimension is generated, and that the functional carrier is machined according to the layout in order for the functional assembly to be produced.

According to one advantageous refinement it can be provided that the at least one connection element is selected from a predefined number of standard shapes. In this way it can be guaranteed that a functional sanitary functional assembly is created at all times, because a user has a limited possibility of combinations as a result of the predefined numbers.

It can furthermore be provided that during machining at least one receptacle channel for the at least one connection element is configured in the functional carrier.

According to a further advantageous design embodiment it can be determined for generating the circuit diagram which fluidic bifurcations are required, in particular wherein a matching bifurcation element for each bifurcation is selected from the sanitary construction kit.

According to one advantageous refinement, for generating the layout at least one shape of the at least one connection element can be used, in particular uploaded or computed.

It can furthermore be provided that at least one externally accessible opening for receiving the outflow element and/or the at least one control element is configured on the functional carrier. The assembling can be facilitated in this way.

According to one refinement it can be provided that at least two dissimilar control elements are used, for example at least two control elements which have dissimilar structural designs and have dissimilar or identical functions. The control elements can in particular be fluidically disposed in parallel or in series, and/or each control element can be assigned an individual outflow element.

According to one further advantageous design embodiment, at least two outflow elements that are selectively operable and/or are fed from a common supply connector can be disposed above a common collection vessel.

It can be particularly advantageous for the functional carrier to be part of an item of furniture or of a sanitary installation or of a sanitary object.

The object mentioned above can be achieved according to the invention in particular by a sanitary functional assembly, in particular produced by a method as described and/or claimed herein, and/or from a sanitary construction kit as is described and/or claimed herein, wherein at least two control elements are fed from a common supply connector and are in each case routed toward an individually assigned outflow element.

The invention moreover relates to a use of a current generator which is disposed in a water circuit of a functional carrier, in particular from a sanitary construction kit as is described and/or claimed herein, for the electrical supply, in particular by way of an electric interim storage, of an electrically operable functionality which is preferably isolated from the water circuit.

The components of the sanitary construction kit are preferably specified and configured for buried or concealed assembling. The control elements, the functional units and/or the outflow elements here can in each case have a fastening means.

In general terms, the invention offers the possibility of retrieving various functional units, for example outflow elements and control elements, from a construction kit as required, and of individually connecting said various functional units by preferably flexible connection elements (for example hoses).

Therefore, the control elements of the construction kit can have hose connectors for the water inflow and the water outflow, said control elements being fluidically connectable to said hose connectors by way of connection elements.

BRIEF DESCRIPTION OF THE DRAWINGS

The invention will now be described in more detail by means of a plurality of exemplary embodiments but is not limited to these exemplary embodiments. Further exemplary embodiments are derived by combining the features of individual claims or a plurality of claims with one another and/or with individual or a plurality of features of the exemplary embodiments.

In the figures.

DETAILED DESCRIPTION

Figure 1:
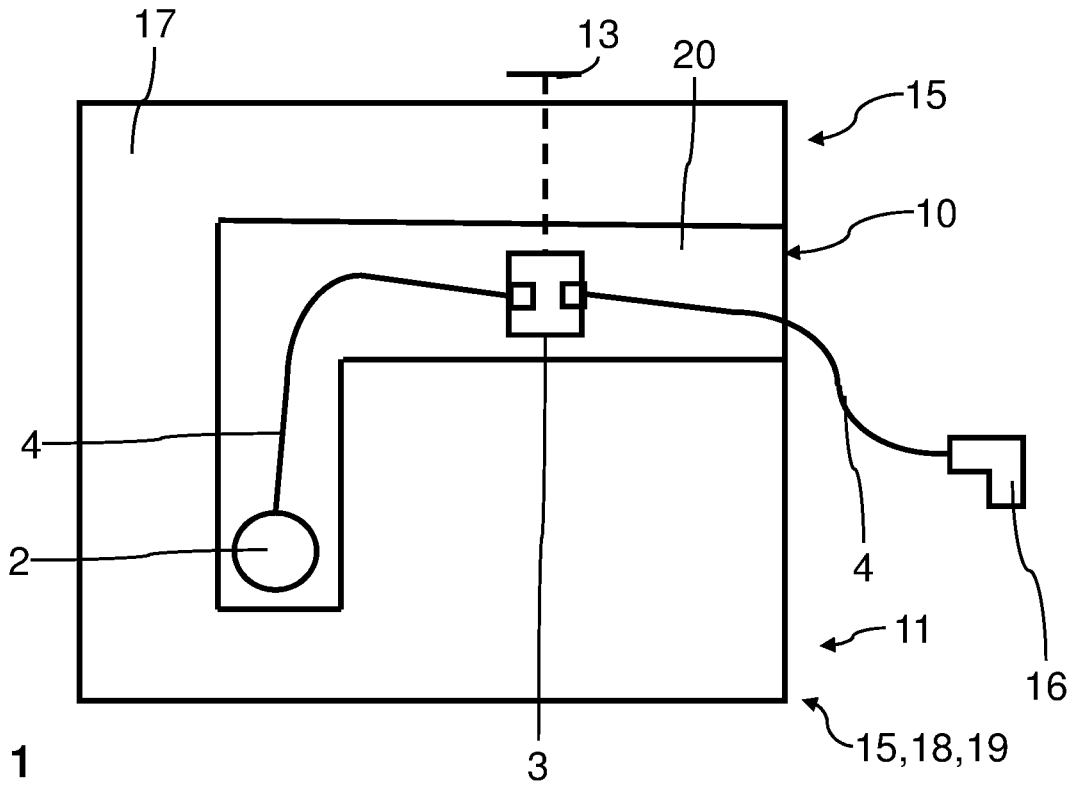
FIG. 1 shows a first potential variant of embodiment of a sanitary functional assembly according to the invention of a sanitary construction kit according to the invention.

A plurality of exemplary embodiments of sanitary functional assemblies of a sanitary construction kit according to the invention are shown in FIGS. 1-5, 7-11, said sanitary functional assemblies being in each case denoted by the reference sign 15.

The sanitary construction kit 1 (cf. FIG. 6) is specified to enable a sanitary functional assembly 15 to be configured in that the desired components of the sanitary construction kit 1 are connected to one another according to a construction manual.

The sanitary construction kit 1 comprises at least one outflow element 2 from which a fluid, in particular a water jet, exits during the use of a sanitary functional assembly 15.

In order to be able to control the exit from the outflow element 2, the sanitary construction kit 1 has at least one control element 3 and at least one connection element 4 by way of which the outflow element 2 is fluidically connectable to the control element 3, or in the assembled state is connected to the latter.

The sanitary construction kit 1 comprises at least two functionally dissimilar control elements 3 which selectively, by way of the at least one connection element 4, are fluidically connectable to the outflow element 2.

Figure 2:
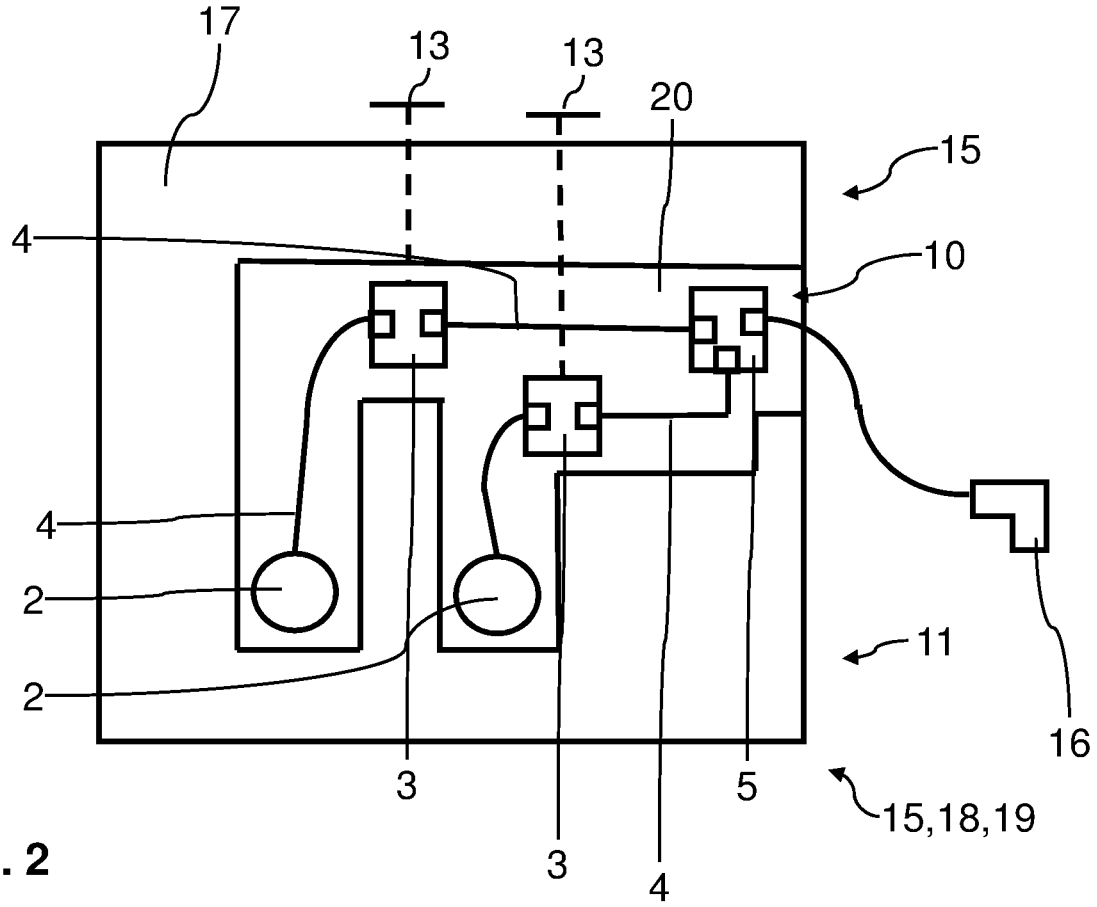
FIG. 2 shows a second potential variant of embodiment of a sanitary functional assembly according to the invention of a sanitary construction kit according to the invention.
Figure 3:
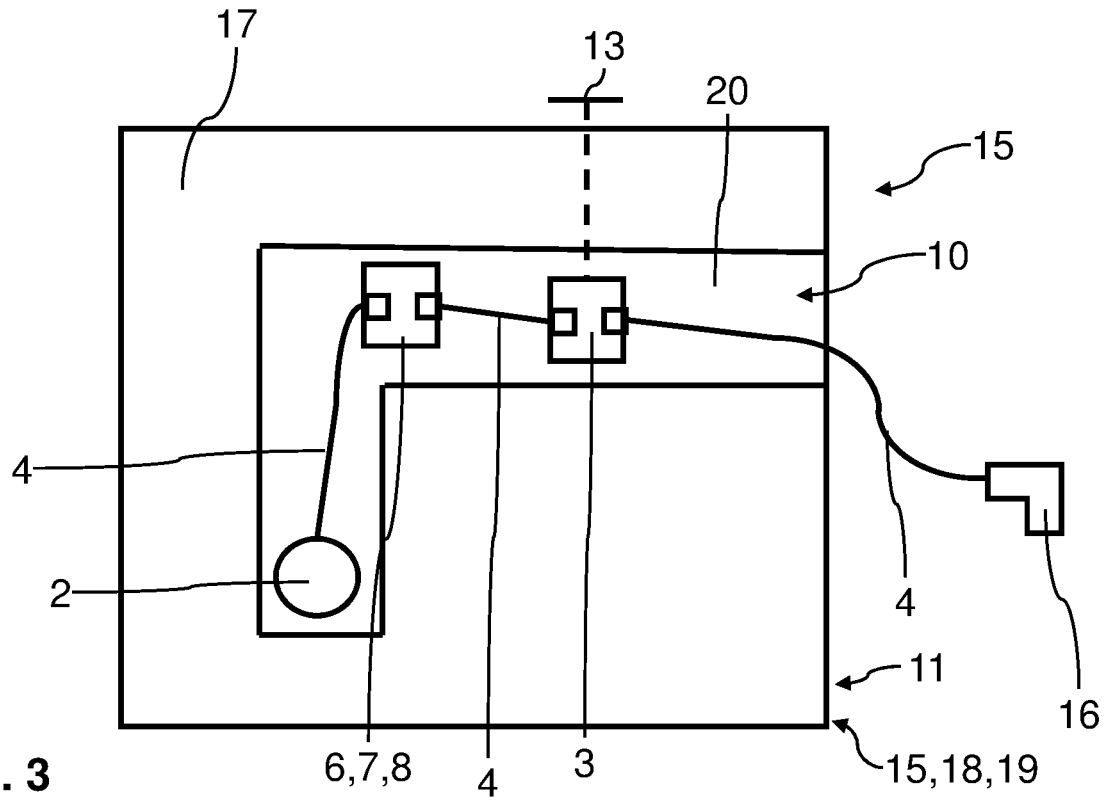
FIG. 3 shows a third potential variant of embodiment of a sanitary construction kit according to the invention of a sanitary functional assembly according to the invention.
Figure 6:
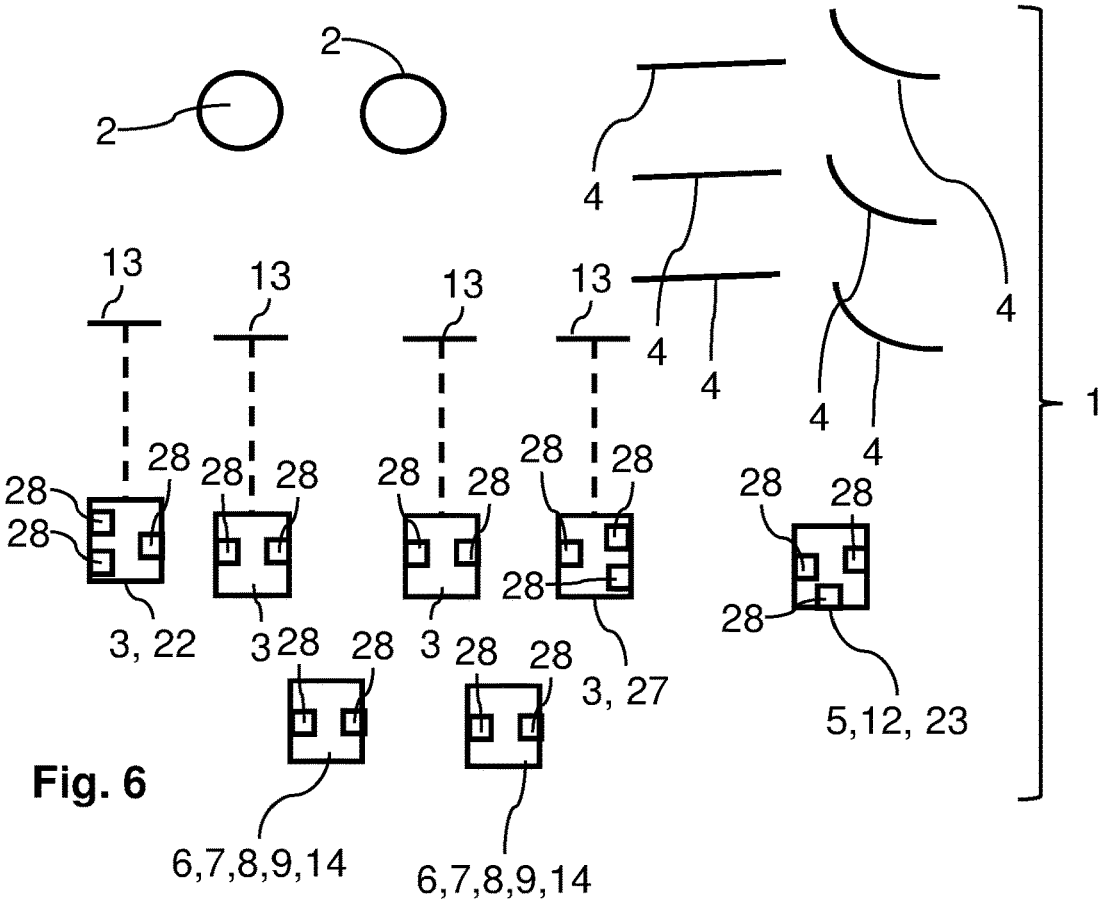
FIG. 6 shows components of a sanitary construction kit according to the invention for configuring the various sanitary functional assemblies.
Figure 7:
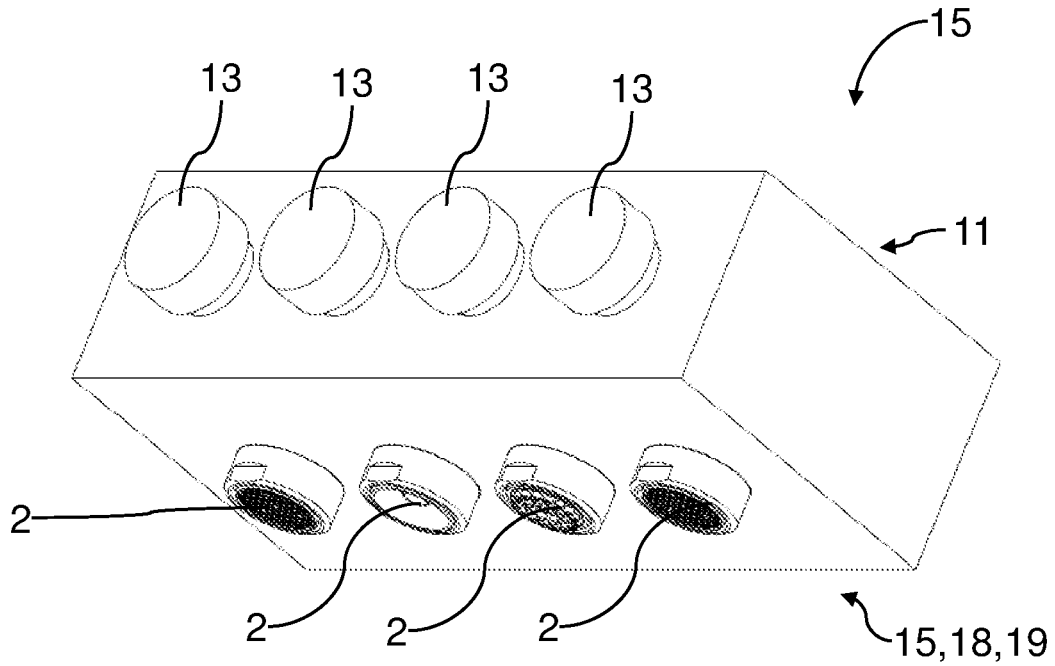
FIG. 7 shows a special variant of embodiment of a sanitary functional assembly according to the invention of a sanitary construction kit according to the invention, in a perspective view, having a plurality of outflow elements of dissimilar design.

The sanitary construction kit 1, or the variants of embodiment of the sanitary functional assembly 15 from FIGS. 2, 6 and 7, respectively, has/have a distributor 5 to which two or more, preferably functionally dissimilar, control elements 3 and/or connection elements 4 and/or outflow elements 2 are simultaneously connectable, or in the assembled state are connected.

In order to enable ideally simple assembling, the at least one connection element 4 is configured so as to be plug-connectable. In order to prevent a plugged connection to be released, the at least one connection element 4 and/or the component connected thereto can have a latching and/or blocking mechanism for fixedly connecting the components to one another.

In order to be able to configure a multiplicity of sanitary functional assemblies 15 of dissimilar designs, the at least one connection element 4 is configured so as to be variable in terms of shape. Pre-shaped connection elements 4 and/or connection elements 4 of dissimilar length may also be present.

The sanitary construction kit 1 and/or the sanitary functional assembly 15 has/have at least one connector element for connecting to a supply connector 16 (in particular of a supply network). One connector element can be provided per supply network, in particular per connector, for a functional assembly 15 which is specified for being connected to a plurality of supply connectors 16 of a supply network or of a plurality of supply networks, thus in particular a warm water connector and a cold water connector.

The sanitary construction kit 1 comprises at least one functional unit. The at least one functional unit can have one or a plurality of functions. Examples to this end can include: at least one further control element 3, a sensor 6 and/or an actuator 7, for example a flow heater 8 and/or a current generator 9. The functional unit is connectable directly to the control element 3 and/or to the outflow element 2, and/or indirectly by way of a connection element 4.

The sanitary construction kit 1 furthermore comprises at least two dissimilar connection elements 4 having conforming connectors, said connection elements 4 being in particular of dissimilar shape and/or dissimilar length. In this way, a user can select a connection element 4 that matches the installation situation and meets the requirements.

The sanitary construction kit 1 comprises a plurality of fastening means 10 for fastening the at least one outflow element 2 and/or the at least one control element 3 and/or of the at least one connection element 4 to a functional carrier 11.

The sanitary construction kit 1 comprises at least one bifurcation element 12, in particular a more than twofold bifurcating bifurcation element 12, by way of which at least one connection element 4 for forming the distributor 5 is selectively connectable.

In order to be able to perform manual regulation, the at least one control element 3 has a manual operating element 13. The manual operating elements 13 of two dissimilar control elements 3 here have a conforming external contour and/or external dimension so as to be able to be selectively used by a user while requiring the same space.

Figure 8:
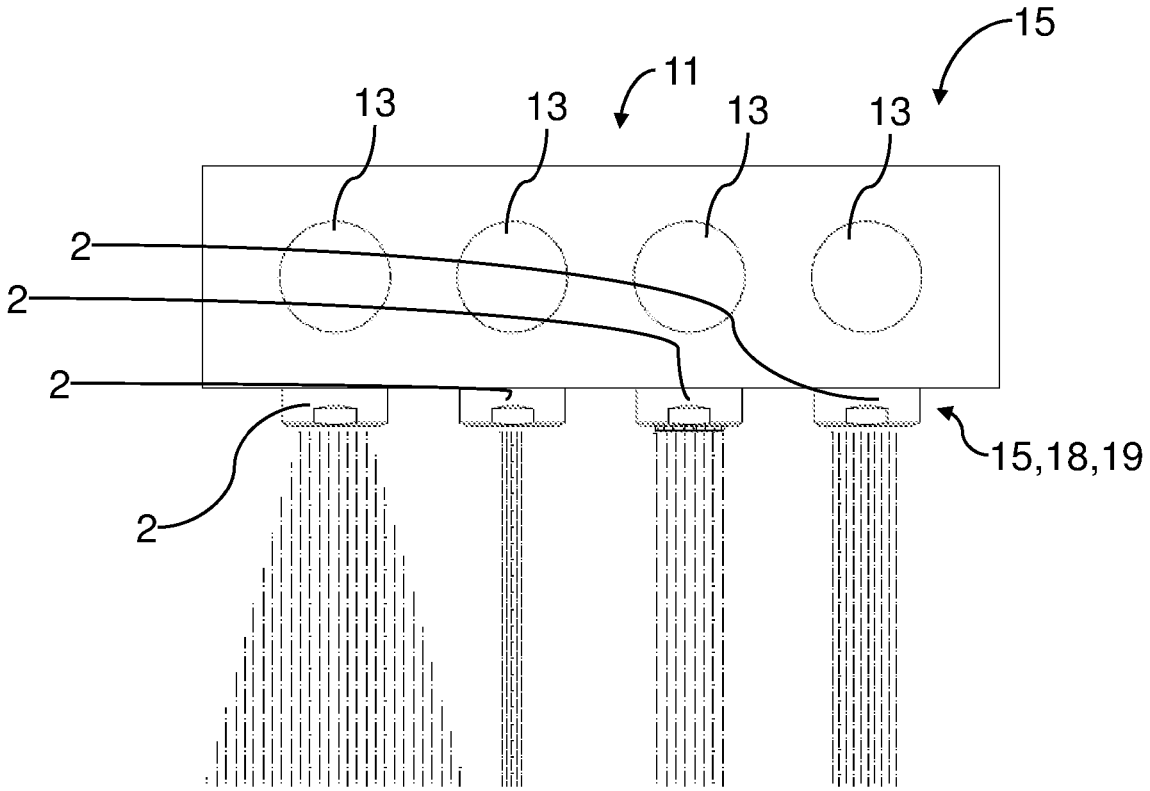
FIG. 8 shows the variant of embodiment from FIG. 7, wherein the water jets configured dissimilarly by the individual outflow elements are illustrated.

The sanitary construction kit 1 and/or the sanitary functional assembly 15 have/has at least two outflow elements 2, preferably two dissimilar outflow elements 2 from FIGS. 2, 7 and 8. Said outflow elements 2 can in particular be of dissimilar flow rate classes and/or jet shapes and/or jet types. The outflow elements 2 are selectively connectable or connected to at least one control element 3 (cf. FIGS. 2, 7 and 8).

Figure 4:
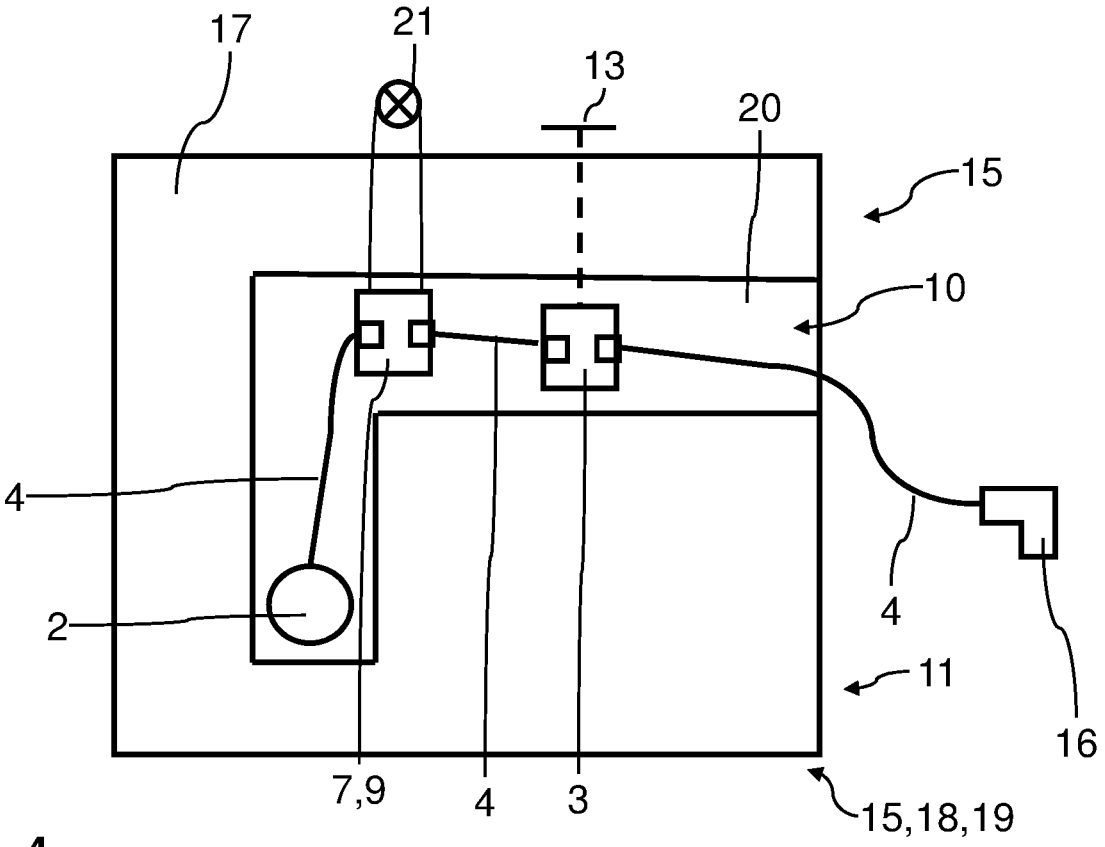
FIG. 4 shows a fourth potential variant of embodiment of a sanitary functional assembly according to the invention of a sanitary construction kit according to the invention.
Figure 5:
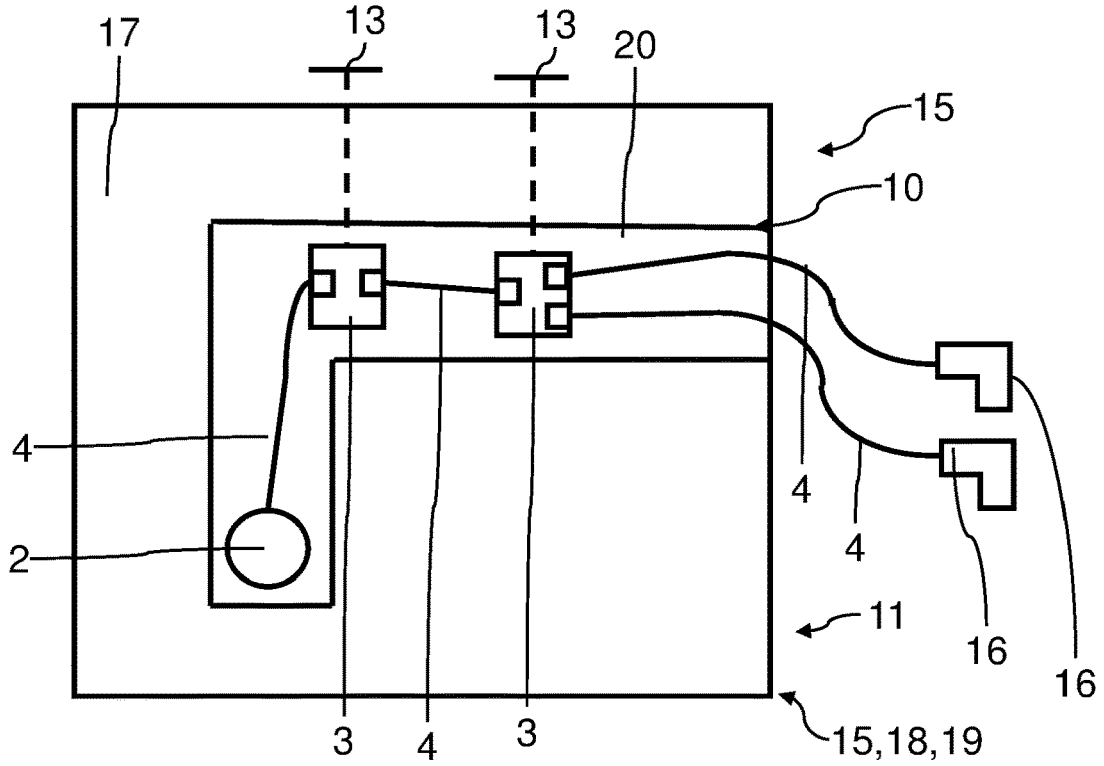
FIG. 5 shows a fifth potential variant of embodiment of a sanitary functional assembly according to the invention of a sanitary construction kit according to the invention.

A variant of embodiment which has a current generator 9 is shown in FIG. 4. Said variant of embodiment can additionally comprise an electric interim storage 14 which is operatively connectable, or operatively connected, to a water circuit 19 comprising the outflow element 2. For example, the current generator 9 can serve for supplying the current of a consumer of the sanitary construction kit 1 or of an external consumer such as, in particular, a light 21, in particular an illumination of an item of furniture. The current generator 9 can be fluidically connectable, or connected, to the control element 3 and/or the connection element 4 and/or the outflow element 2.

The sanitary functional assemblies 15 and/or items of furniture 17 and/or sanitary installations 18 comprising a sanitary functional assembly 15 shown in FIGS. 1-5 have in each case at least one outflow element 2, at least one control element 3 and at least one connection element 4 by way of which the outflow element 2 is fluidically connected to the control element 3, wherein at least two dissimilar control elements 3 are present, wherein the control elements 3 are fluidically disposed in parallel or in series, and/or each control element 3 is assigned an individual and/or a common outflow element 2.

In the variant of embodiment shown in FIG. 2, the two control elements 3 are fed from a common distributor element 5.

In the variants of embodiments from FIGS. 1-5, a functional carrier 11 is in each case equipped with a sanitary functional assembly 15.

A variant of embodiment having in each case a plurality of, in particular four, dissimilarly configured outflow elements 2 is shown in FIGS. 7 and 8. For example, the outflow elements 2 can be configured for shaping jet shapes of dissimilar shape. In particular for configuring at least one or a plurality of jet shapes selected from: aerated, non-aerated, pulsed, spray, continuous, CO2-enriched (can also be achieved by way of a functional unit), filtered (can also be achieved by way of a functional unit), unfiltered, distilled (can also be achieved by way of a functional unit). Alternatively or additionally thereto, the jet can be heated or unheated, in particular when a functional unit configured as a flow heater 8 is provided. Furthermore, alternatively or additionally, the jet can be cooled, in particular when a functional unit configured as a flow chiller is provided.

The control element 3 can be operated manually, for example by way of the manual operating element 13. The control element 3 can comprise a valve which is preferably able to be regulated by means of the manual operating element 13. The manual operating element 13 can, for example, be configured as an on/off push button, and/or be connected to a push-push adjustment mechanism (controlled only by pushing, similar to a ballpoint pen). Alternatively or additionally, the manual operating element 13 can be adjusted by a rotation, and/or the flow rate can be regulated by a valve.

The control element 3 can also be regulated in an automated manner. In particular, the control element 3 can be connected to a sensor 6, particular a temperature sensor, so as to establish an, in particular automated, feedback control as a function of a measured value, in particular a temperature-sensitive feedback control.

Figure 9:
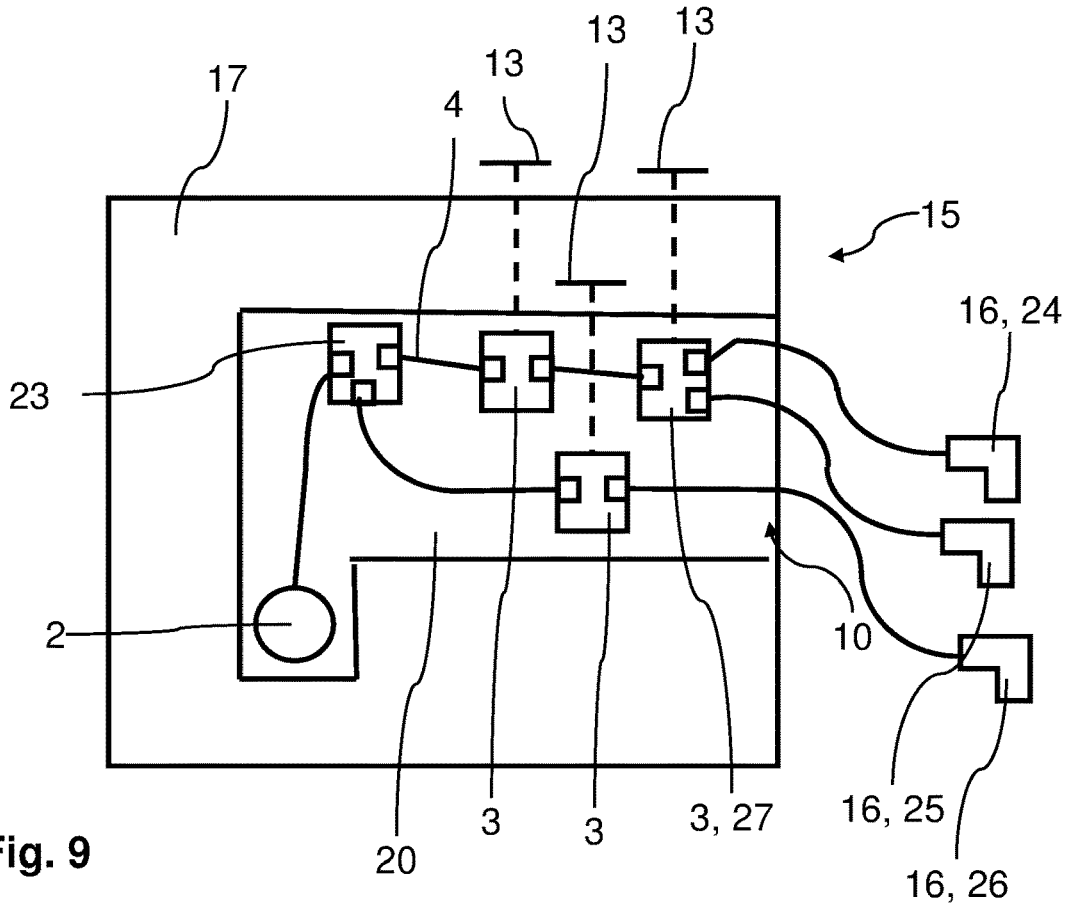
FIG. 9 shows a further variant of embodiment of a sanitary functional assembly, formed from a sanitary construction kit.

FIG. 9 shows a further sanitary functional assembly 15 according to the invention. Components and functional units which in terms of function and/or construction are equivalent or identical to the preceding exemplary embodiments are denoted by the same reference sign and are not described separately once again. Therefore, the explanations pertaining to FIGS. 1 to 8 apply in analogous manner to FIG. 9.

In the exemplary embodiment as per FIG. 9, three supply connectors 16 are present: a cold water connector 24, a warm water connector 25 and a hot water connector 26. Additionally to the hot water connector 26 and/or instead of this hot water connector 26, a connector for carbonized water, potable water, particularly purified water and/or for a further fluid such as soap, oil, milk, etc., may also be present.

The hot water connector 25 and the cold water connector 24 are routed to a common control element 3 which is configured as a mixer unit 27, for example as a 2-way valve. The mixer unit 27 is routed to a control element 3 which is configured as a shut-off valve.

The hot water connector 26 is routed to a further control element 3 which is likewise configured as a shut-off valve.

Both control elements 3 are connected to a combination unit 23, for example a distributor 5 which is operated in the reverse direction. The combination unit 23 routes both fluids to a common outflow element 2. The control elements 3 are thus disposed in parallel.

In a further exemplary embodiment, a warm water connector is configured instead of the hot water connector 26, while the warm water connector 25 shown in FIG. 9 and the mixer unit 27 are not present.

If the control elements 3 in this case are configured as valves having an opening which is preferably adjustable in a stepless manner or in fine steps, a mixer unit is thus implemented from elementary individual components. This demonstrates that a sanitary construction kit 1 does not necessarily have to have a mixer unit in order for a function of a mixer unit to be implemented.

Figure 10:
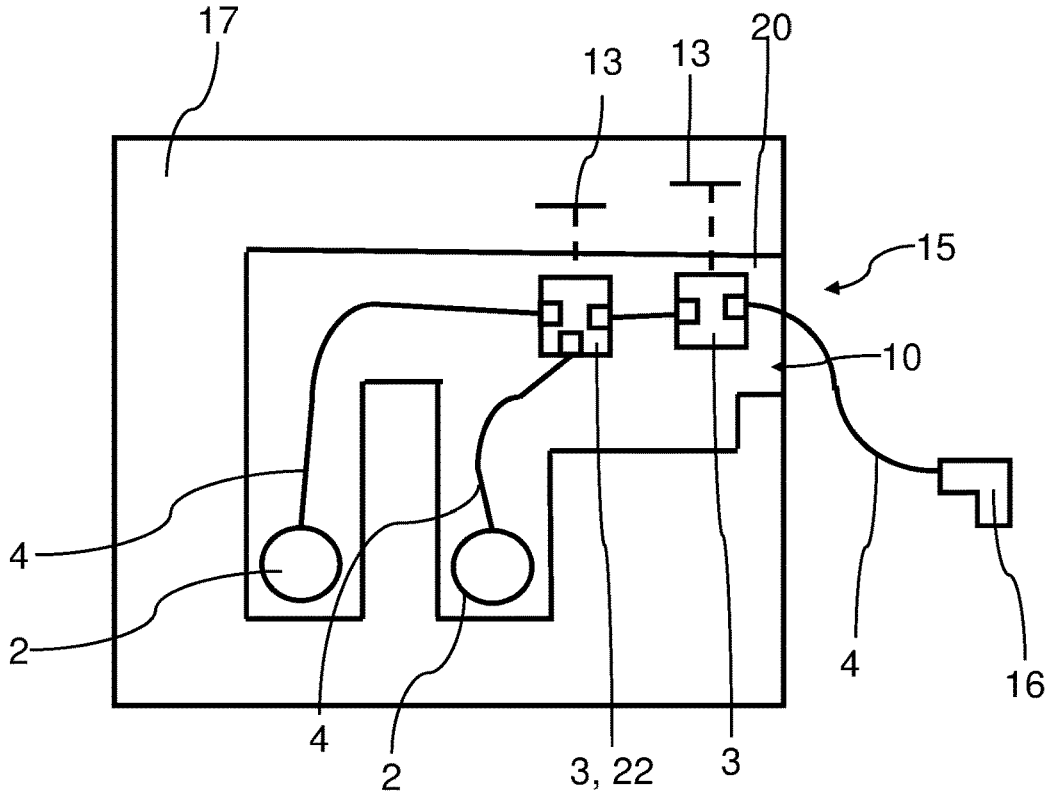
FIG. 10 shows a further variant of embodiment of a sanitary functional assembly, formed from a sanitary construction kit.

FIG. 10 shows a further sanitary functional assembly 15 according to the invention. Components and functional units which in terms of function and/or construction are equivalent or identical to the preceding exemplary embodiments are denoted by the same reference sign and are not described separately once again. Therefore, the explanations pertaining to FIGS. 1 to 9 apply in analogous manner to FIG. 10.

The supply connector 16 is routed to an assembly in series of a control element 3 as a shut-off valve and of a control element 3 as a switchover unit 22. The switchover unit 22 can have two or three (or more than three) switching positions, for example for each of the two (or a plurality of) outflow elements 2 (i.e. at least two switching positions) and/or a common switching position for both outflow elements 2 (third switching position).

Figure 11:
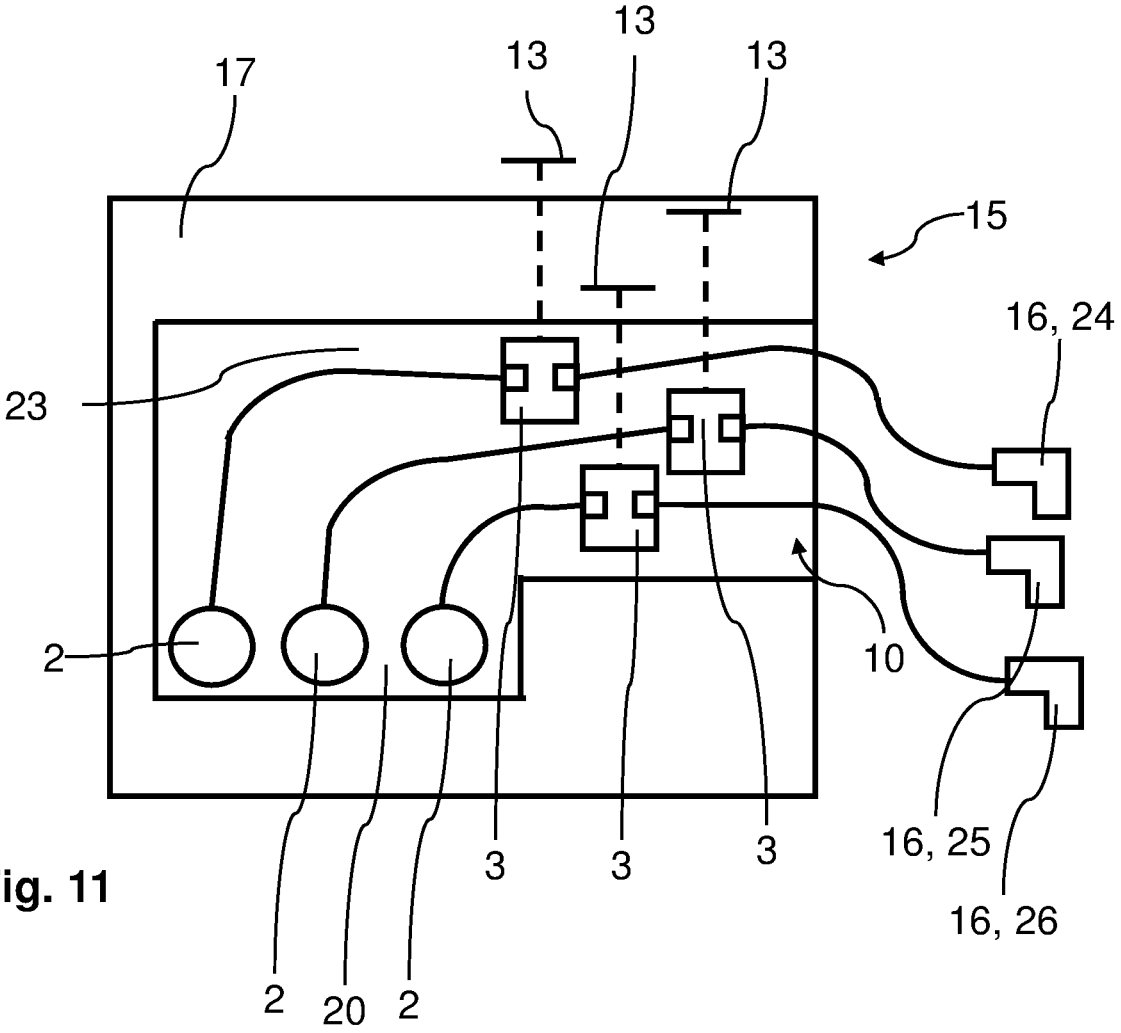
FIG. 11 shows a further variant of embodiment of a sanitary functional assembly, formed from a sanitary construction kit.

FIG. 11 shows a further sanitary functional assembly 15 according to the invention which, like the embodiment of FIG. 9, has three supply connectors 16. Wherein the number of supply connectors can be easily changed to more or fewer than three. For example, the supply connector 24 here can be a cold water connector, the supply connector 25 can be a sparkling water connector, thus for carbonated water, and the supply connector 26 can be a hot water connector, in particular for boiling water. Each supply connector 16 is connected to one control element 3 way of a connection element 4. In this example, all control elements 3 are configured as shut-off valves which are controllable by way of a manual operating element 13, for instance a push button (for example having a push-push mechanism).

The embodiment moreover has three outflow elements 2 which by way of a connection element 4 are in each case connected to one of the control elements 3. In this way, each supply connector 16 is routed to a separate outflow element 2. In this way, a beverage station in which the different beverages are strictly separated can be configured, for instance. As a result, an improved allocation may be possible and a spatial separation can take place.

The functional assembly 15 can be configured in a manner similar as is shown in FIG. 7, for example.

FIG. 6 by way of example shows the component parts of a sanitary construction kit 1 according to the invention, from which the sanitary functional assemblies 15 described can be formed, wherein for the purpose of visualizing the idea, only a limited number of copies of the component parts are in each case shown here. Connection locations 28 for connecting the connection elements 4 can in each case be seen.

The invention thus relates in particular to a sanitary construction kit 1, having at least one outflow element 2, at least one control element 3, and at least one connection element 4 by way of which the outflow element 2 is fluidically connectable to the control element 3, wherein at least two functionally dissimilar control elements 3 which selectively are fluidically connectable individually or conjointly to the outflow element 2 are comprised.

LIST OF REFERENCE SIGNS

1 Sanitary construction kit
2 Outflow element
3 Control element
4 Connection element
5 Distributor
6 Sensor
7 Actuator
8 Flow heater
9 Current generator
10 Fastening element
11 Functional carrier
12 Bifurcation element
13 Manual operating element
14 Electric storage
15 Sanitary functional assembly
16 Supply connector
17 Item of furniture
18 Sanitary installation
19 Wasser circuit; water line system
20 Channel
21 Light
22 Switchover unit
23 Combination unit
24 Cold water connector
25 Warm water connector
26 Hot water connector
27 Mixer unit
28 Plug-in location

The invention claimed is:

1. A sanitary construction kit (1), comprising:

at least one outflow element (2), at least two functionally dissimilar control elements (3), and at least one connection element (4) with which the at least one outflow element (2) is fluidically connectable to either of the at least two functionally dissimilar control elements (3).

2. The sanitary construction kit (1) according to claim 1, wherein at least one of the at least one connection element (4) is configured to be plug-connectable, or the at least one connection element (4) is configured to be variable in terms of shape.

3. The sanitary construction kit (1) according to claim 1, further comprising at least one connector element configured for connecting to a supply network (16).

4. The sanitary construction kit (1) according to claim 1, further comprising a functional unit including one of a further control element (3), a sensor (6), an actuator (7), a flow heater (8), or a current generator (9), that is connectable to at least one of the at least two functionally dissimilar control elements (3), the at least one outflow element (2), or the at least one connection element (4).

5. The sanitary construction kit (1) according to claim 1, wherein the at least one connection element (4) comprises at least two dissimilar connection elements (4) having conforming connectors.

6. The sanitary construction kit (1) according to claim 1, further comprising fastening means (10) configured on a functional carrier (11) for fastening at least one of the at least one outflow element (2), the at least two functionally dissimilar control elements (3), or the at least one connection element (4).

7. The sanitary construction kit (1) according to claim 1, further comprising at least one bifurcation element (12) configured to form a distributor (5) is selectively connectable to the at least one connection element (4).

8. The sanitary construction kit (1) according to claim 1, wherein each of the at least two functionally dissimilar control elements (3) has a manual operating element (13), and the manual operating elements (13) of the two functionally dissimilar control elements (3) have at least one of a conforming external contour or external dimension.

9. The sanitary construction kit (1) according to claim 1, wherein the at least one outflow element (2) includes at least two dissimilar outflow elements (2) that are selectively connectable to either of the at least two functionally dissimilar control elements (3).

10. The sanitary construction kit (1) according to claim 1, further comprising a current generator (9) that is operatively connectable to a water circuit (19) comprising the at least one outflow element (2).

11. The sanitary construction kit (1) according to claim 1, wherein the at least two functionally dissimilar control elements (3) is at least one of a manually controllable, temperature-controlled, or pressure-controlled valve.

12. The sanitary construction kit (1) according to claim 1, wherein the at least one connection element (4) is at least one of composed of a temperature-resistant material configured as a flexible hose.

13. A sanitary construction kit (1), comprising:

at least one outflow element (2), at least two functionally dissimilar control elements (3), at least one connection element (4) with which the at least one outflow element (2) is fluidically connectable to either of the at least two functionally dissimilar control elements (3), and at least one distributor (5) to which at least any two elements out of the at least two functionally dissimilar control elements (3), the at least one connection element (4), or the at least one outflow element (2) are simultaneously connectable.

14. A sanitary functional assembly (15), comprising:

at least one outflow element (2), at least two functionally dissimilar control elements (3), at least one connection element (4) with which the at least one outflow element (2) is fluidically connected to either of the at least two functionally dissimilar control elements (3), and at least one of (a) the at least two functionally dissimilar control elements (3) are fluidically disposed in parallel or in series, or (b) each of the at least two functionally dissimilar control elements (3) is assigned a common outflow element (2).

15. The sanitary functional assembly (15) according to claim 14, wherein the at least two control elements (3) are fed from a common distributor element (5).

16. An item of furniture (17) comprising the sanitary functional assembly (15) according claim 14.

17. A sanitary functional assembly (15), comprising:

at least two outflow elements (2), at least two functionally dissimilar control elements (3), at least one connection element (4) with which the at least two outflow elements (2) are fluidically connected to either of the at least two functionally dissimilar control elements (3), the at least two outflow elements (2) are dissimilar, and at least one of the at least two outflow elements (2) are fluidically disposed in parallel or in series, or each said outflow element (2) is a common control element (3).

18. The sanitary functional assembly (15) according to claim 14, wherein the at least two functionally dissimilar control elements (3) are in each case fed from a separate supply connector (16).

19. A method for producing a sanitary functional assembly (15), comprising:

equipping a functional carrier (11) with the functional assembly (15), entering at least one dimension of the functional carrier (11)

entering a desired scope of functions, selecting at least one outflow element (2), at least one control element (3) and at least one connection element (4) from a sanitary construction kit (1), generating a circuit diagram with a desired scope of functions being implemented, generating a layout for placing the selected elements of the sanitary construction kit (1) within the at least one dimension, and machining the functional carrier (11) according to the layout in order to produce the functional assembly (15).

20. The method according to claim 19, wherein the at least one connection element (4) is selected from a predefined number of standard shapes.

21. The method according to claim 19, further comprising during machining, configuring at least one receptacle channel (20) for the at least one connection element (4) in the functional carrier (11).

22. The method according to claim 19, further comprising determining which fluidic bifurcations are required for generating the circuit diagram, and selecting a matching bifurcation element (12) from the sanitary construction kit (1) for each bifurcation.

23. The method according claim 19, further comprising, for generating the layout, uploading or computing at least one shape of the at least one connection element (4).

24. The method according to according to claim 19, further comprising configuring at least one of an externally accessible opening for receiving the at least one outflow element (2) or the at least one control element (3) on the functional carrier (11).

25. The method according to claim 19, further comprising using at least two dissimilar ones of the control elements (3).

26. The method according claim 19, wherein at least two of the outflow elements (2) that are at least one of selectively operable or fed from a common supply connector (15) are disposed above a common collection vessel.

27. The method according to claim 19, wherein the functional carrier is part of an item of furniture or of a sanitary installation.

28. The sanitary functional assembly (15) produced by the method according to claim 19, wherein there are at least two of the control elements (3) that are fed from a common supply connector (16) and are routed toward an individually assigned outflow element (2).

* * * * *